United States Patent [19]

Becker et al.

[11] Patent Number: 4,490,123

[45] Date of Patent: Dec. 25, 1984

[54] WHISTLE FOR CHILDREN'S BOOK

[76] Inventors: James F. Becker, 3008 3rd St., Apt. A; Andrew S. Mayer, 706-1/2 Ashland Ave., both of Santa Monica, Calif. 90405

[21] Appl. No.: 443,179

[22] Filed: Nov. 22, 1982

[51] Int. Cl.[3] ..... A63H 5/00

[52] U.S. Cl. ..... 446/204; 446/404; 281/15 R; 281/1

[58] Field of Search ..... 46/175 R, 174, 179, 46/178, 180, 181, 34, 35; 281/15 R, 1

[56] References Cited

U.S. PATENT DOCUMENTS

| | | | |
|---|---|---|---|
| 2,906,058 | 9/1959 | Barker | 46/35 X |
| 3,323,251 | 6/1967 | Henry | 46/175 R |
| 4,249,757 | 2/1981 | Gella | 281/15 R |

FOREIGN PATENT DOCUMENTS

| | | | |
|---|---|---|---|
| 808930 | 2/1937 | France | 281/1 |

*Primary Examiner*—M. Yu

*Attorney, Agent, or Firm*—Knobbe, Martens, Olson & Bear

[57] ABSTRACT

A whistle is integrally formed from the pages of a children's book. Apertures are formed in adjacent, interior pages, and the apertures are positioned to overlap to form a resonant cavity. A slot is provided in one of the interior pages to provide an air inlet passage through which air may be blown into the resonant cavity. The cover of the book has an opening which forms an air outlet passage, through which air from the resonant cavity is exhausted. In operation, the pages of the book are pressed tightly together to seal the resonant cavity and prevent air leakage therefrom. To facilitate such sealing, the book includes printed matter indicating the general location in which the child should place his fingers when pressing the pages together.

11 Claims, 7 Drawing Figures

Fig. 1
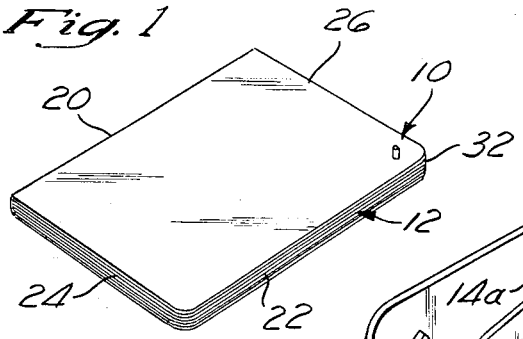
Fig. 2
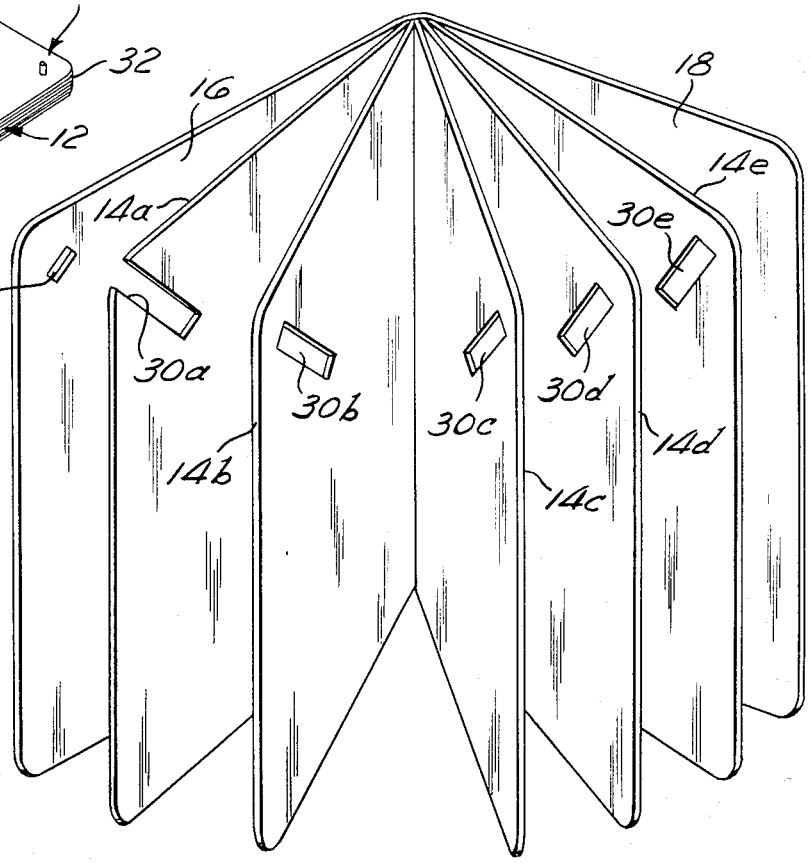
Fig. 3
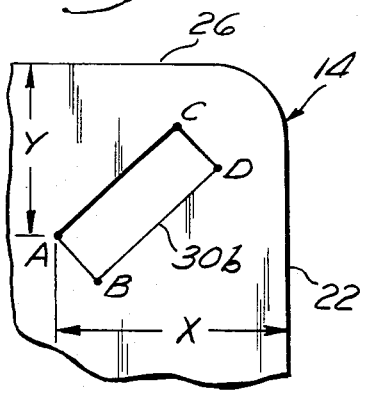
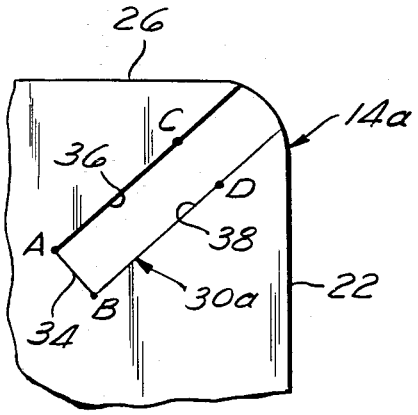
Fig. 4
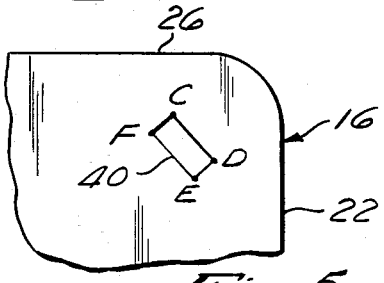
Fig. 5
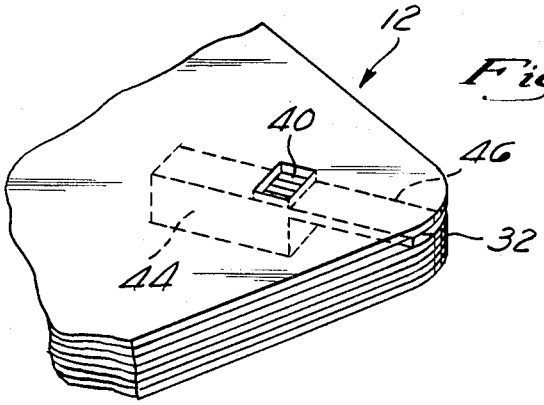
Fig. 7
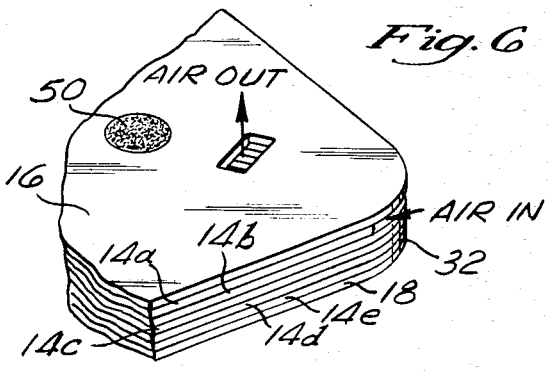
Fig. 6

WHISTLE FOR CHILDREN'S BOOK

BACKGROUND OF THE INVENTION

The present invention relates to whistles, and particularly to children's books having whistles.

Children's books often include entertainment devices to enhance the reader's enjoyment. Such entertainment devices include, for example, pop-up figures, puppets, and whistles.

In prior art books having whistles, the whistles are typically attached to the book by a cord or string. However, if the cord or string is broken, the whistle may become lost. Further, for small children, there is a risk that the whistle may be swallowed; and thus, cause injury to the child.

SUMMARY OF THE INVENTION

The present invention comprises a children's book in which a whistle is integrally formed from the pages of the book. Apertures are formed in adjacent, interior pages, and the apertures are positioned to overlap to form a resonant cavity. A slot is provided in one of the interior pages, adjacent to the resonant cavity, to provide a passage through which the child can blow air into the resonant cavity. The slot is interposed between the resonant cavity and an aperture formed in an adjacent page, e.g., in the cover of the book. This cover page cooperates with the slot to provide an inlet air passage through which the child blows air, and an outlet air opening, through which air from the resonant cavity is exhausted.

Preferably, the pages of the book comprising the whistle should be pressed tightly together by the child's fingers (e.g., between the thumb and index finger) to seal the pages together and prevent leakage from the resonant cavity and air inlet passage. To facilitate such sealing, and thus, insure proper performance of the whistle, the book includes printed matter indicating the general location in which the child should place his fingers when pressing the pages together. Such printed matter may comprise, for example, a dot upon which the child's index fingers should be positioned.

These and other features of the present invention are best understood through reference to the drawings.

DESCRIPTION OF THE DRAWINGS

FIG. 1 is a perspective view of the whistle of the present invention, integrally formed from the pages of a children's book, showing the book in a closed condition;

FIG. 2 is a perspective view of the book of FIG. 1, in an open condition, illustrating the overlapping apertures in slot which form the whistle of the present invention;

FIG. 3 is a schematic drawing showing one preferred location for the apertures which form the resonant cavity of the whistle;

FIG. 4 is a schematic drawing showing one preferred location for the slot which forms the air inlet passage for the whistle;

FIG. 5 is a schematic drawing showing one preferred location for the aperture in the book cover page, which provides an air outlet passage;

FIG. 6 is a partial perspective view of the whistle, with the pages of the book closed, showing the air inlet passage and air outlet passage, and illustrating one preferred location for printed matter, such as a dot, for indicating the position where pressure should be applied to compress the pages of the book to seal the resonant cavity of the whistle, and prevent air leakage therefrom;

FIG. 7 is a schematic drawing of the whistle shown in FIG. 6 illustrating the configuration of the resonant cavity, air inlet passage, and air outlet passage.

DETAILED DESCRIPTION OF THE PREFERRED EMBODIMENT

As shown in FIG. 1, the present invention comprises a whistle 10, integrally formed from the pages of a children's book 12. By way of specific example, the book 12 may comprise seven pages, including five interior pages 14*a–e*, a front cover page 16, and a back cover page 18, as best seen in FIG. 2. The pages may be rectangular, each having four marginal edges 20, 22, 24, and 26 (FIG. 1) with the edges 20 and 22 forming the sides of the book 12, and edges 24 and 26 forming the bottom and top, respectively of the book 12. The book 12 may be bound along the marginal edge 20. In the embodiment shown, the pages 14*a–e*, 16 and 18 are all the same size (e.g., $5\frac{3}{4}\times7\frac{3}{4}$ inches), and formed from e.g. 1/16 inch cardboard.

As shown in FIG. 2, the pages are arranged so that the interior pages 14*b–e* are interposed between the interior page 14*a* and the back cover 18, while the interior page 14*a* is interposed between the front cover 16 and the interior page 14*b*. The pages 14*b–e* have apertures 30*b–e*, respectively, formed therein, e.g., by die-cutting. The apertures 30*b–e* are e.g. rectangular, and may be disposed at a corner of the book 12, e.g., at the corner 32 formed by the marginal edges 22, 26 (FIG. 1). In addition, the apertures 30*b–e* overlap each other, and, in the embodiment shown, are equal in size and are congruent when the book 12 is closed.

The location of the apertures 30*b–e* on the pages 14*b–e*, respectively, may be more fully understood through reference to FIG. 3 which shows the four corners, designated by points A, B, C, D, respectively, of the aperture 30*b*. The location of the corners A, B, C, D, for the specific embodiment shown, may be described in terms of dimensions x and y, where x is the distance between the marginal edge 22 and any one of the corners A, B, C, D, and y is the distance between the marginal edge 26 and any one of the corners A, B, C, D. Although only the corner A is labeled in FIG. 3 as having dimensions x and y, it will be understood that each of the other corners B, C, D have corresponding x and y dimensions. By way of specific example, these x and y dimensions for each of the corners A, B, C, D may be as follows:

| Corner | X | Y |
|---|---|---|
| A | 39 mm | 28 mm |
| B | 32.5 mm | 35 mm |
| C | 18 mm | 9 mm |
| D | 11 mm | 17 mm |

It will be understood that each of the corners A, B, C, D for the remaining apertures 306-*e* may have the same x-y dimensions.

Referring now to FIGS. 2 and 4, the page 14*a* includes a slot 30*a*, formed, e.g., by die-cutting, and defined by edges 34, 36, and 38. The orientation of these edges 34, 36, and 38 may be determined by locating the points A, B, C, D, using the x and y dimensions as discussed above in reference to FIG. 3. The edge 36 extends from point A, through point C, to the marginal edge 26, while the edge 38 extends from point B through point D to the marginal edge 22. The edge 34 extends between points A and B. Thus, the slot 30*a* is similar to the apertures 30*b–e*, except that the edges thereof extend to the marginal edges 22 and 26 of the page 14*a*.

Finally, referring to FIGS. 2 and 5, the front cover 16 includes an aperture 40, formed, e.g., by die-cutting. This aperture may also be rectangular, the corners of which are defined by the points C, D, E, F, as shown in FIG. 5. Exemplary x and y dimensions for the aperture 40 are provided below:

| Corner | X | Y |
|---|---|---|
| C | 18 mm | 9 mm |
| D | 11 mm | 17 mm |
| E | 14.5 mm | 21 mm |
| F | 22 mm | 12.5 mm |

Note that for the points C and D, the x and y dimensions are the same for the aperture 40 as for the apertures 30*b–e* (FIG. 3). However, the x and y dimensions for the points E and F are less than those for the points A and B, respectively, and thus, the aperture 40 is substantially smaller than the apertures 30*b–e*.

As shown in FIGS. 6 and 7, when the book 12 is closed, the apertures 30*b*–30*e* and slot 30*a* cooperate to form a resonant cavity 44 in the book 12. The slots 30*a* also cooperates with adjacent pages, namely cover page 16 and interior page 30*b*, to provide an air inlet passage 46, which extends from the corner 32 of the book 12 to the resonent cavity 44. The aperture 40 in the front cover 16 forms an air outlet passage 46 for the cavity 44, while the book cover 18, which does not have an aperture, closes the cavity 44. It will be understood that, for clarity of illustration, the edges of the book's pages 14, 16, 18 are not shown in the portion of FIG. 7 depicting the resonent cavity 44, and air inlet passage 46 so that these structural features are clearly visible.

In use, the child blows into the air inlet passage to force air into the resonent cavity 44. The aperture 40 permits air to escape from the cavity 44, while constricting the air flow, thereby, creating an audible tone or whistle.

In the embodiment shown, air forced into the resonant cavity 44 may tend to separate the pages slightly, thereby permitting air to escape from between the pages and thus, causing leakage. To prevent such air leakage and insure proper operation of the whistle, the pages of the book 12 may be squeezed tightly together by the child with his hands. In this regard, proper placement of the child's fingers is important to insure optimum operation of the whistle. Specifically, the child should place his fingers above and below the resonant cavity 44, without obstructing the air outlet passage 46. To insure proper placement of the child's fingers, the present invention includes printed matter, namely, a dot 50 on the front cover 16, adjacent to the air outlet passage 46, above the resonant cavity 44. In such position, the air outlet passage 46 is disposed between the dot 50 and at the corner 32. Placement of the child's index fingers on this dot 50, with his thumbs on the back cover 18, opposite his index fingers, and directly below the cavity 44, effectively seals the resonant cavity 44 and permits proper operation of the whistle.

What is claimed is:

1. A whistle, comprising:

plural, overlapping sheets, having respective apertures positioned to overlap to form a resonant cavity;

a slotted sheet, having an air inlet slot extending to the edge of said sheet, said slot positioned to overlap said resonant cavity to provide an air inlet passage into said resonant cavity;

a cover sheet, having an air outlet aperture therein, positioned to overlap said resonant cavity to permit air input through said air inlet passage to exhaust through said air outlet aperture; and means for maintaining a predetermined relative position among said overlapping sheets.

2. A whistle, as defined by claim 1, wherein said slotted sheet is interposed between said cover sheet and one of said plural overlapping sheets.

3. A whistle, as defined by claim 1, wherein said plural overlapping sheets, slotted sheet, and cover sheet are bound to form a book, and wherein said position maintaining means comprises the binding of said book.

4. A whistle, comprising:

plural sheets, bound together in a book, at least some of said sheets having openings formed therein, the binding of said book positioning said sheets to overlap, and maintaining a predetermined relative position among said openings to form (1) a resonant cavity, (2) an air outlet passage, communicating with said resonant cavity, said air outlet passage sized to constrict air flow from said resonant cavity, and (3) an air inlet passage, communicating with said resonant cavity, and extending between said resonant cavity and a marginal edge of said book, for conducting air into said resonant cavity.

5. A whistle, comprising:

plural sheets, at least some of said sheets having openings formed therein; and means for positioning said sheets to overlap, said positioning means comprising means for maintaining a predetermined relative position among said openings to form (1) a resonant cavity, (2) an air outlet passage, communicating with said resonant cavity, for exhausting air from said resonant cavity, said air outlet passage sized to constrict air flow from said resonant cavity, and (3) an air inlet passage, communicating with said resonant cavity, for conducting air into said resonant cavity, one of said plural sheets including printed matter indicating the location in which to place the user's fingers to pressure said sheets together to seal said resonant cavity.

6. A whistle, as defined by claim 5, wherein said printed matter comprises a dot.

7. A method of whistling comprising:

positioning plural sheets to overlap;

positioning respective openings formed in said plural sheets to overlap to form a resonant cavity, one of said plural sheets having a slot therein, said one sheet disposed between two other of said plural sheets, said slot extending between a marginal edge of said one sheet and said resonant cavity to provide an air inlet passage for said cavity, and forcing air into said cavity.

8. A method of whistling, as defined by claim 7, additionally comprising:

pressing said sheets together to seal said cavity to reduce air leakage.

9. A method of making a whistle, comprising:

providing plural, overlapping sheets, including front and back cover sheets, and plural interior sheets, forming apertures in at least some of said interior sheets;

positioning said apertures to overlap to form a cavity;

forming a slot in one of said interior sheets;

positioning said slot between two of said plural overlapping sheets so that said slot overlaps said apertures in said interior sheets;

forming an aperture in one of said cover sheets, said aperture smaller than said apertures in said interior sheets; and positioning said aperture in said one of said cover sheets to overlap said apertures in said interior sheets.

10. A method of making a whistle, as defined by claim 9, additionally comprising:

positioning said sheet with said slot between and adjacent to, one of said cover sheets and one of said interior sheets.

11. A method of making a whistle, as defined by claim 10, additionally comprising:

binding all of said sheets to form a book.

* * * * *